US005714256A

United States Patent [19]

DeLucia et al.

[11] Patent Number: 5,714,256

[45] Date of Patent: Feb. 3, 1998

[54] METHOD OF PROVIDING A NONWOVEN FABRIC WITH A WIDE BONDING WINDOW

[75] Inventors: Mary Lou DeLucia; Robert Leslie Hudson, both of Roswell, Ga.

[73] Assignee: Kimberly-Clark Worldwide, Inc., Irving, Tex.

[21] Appl. No.: 379,221

[22] Filed: Jan. 27, 1995

[51] Int. Cl.[6] ..... B32B 15/00; D02G 3/00

[52] U.S. Cl. ..... 428/373; 428/357; 428/364; 428/365; 428/351; 428/374

[58] Field of Search ..... 428/357, 364, 428/365, 351, 373, 374, 400

[56] References Cited

U.S. PATENT DOCUMENTS

| | | | |
|---|---|---|---|
| 3,338,992 | 8/1967 | Kinney | 264/24 |
| 3,341,394 | 9/1967 | Kinney | 161/72 |
| 3,502,538 | 3/1970 | Petersen | 161/150 |
| 3,502,763 | 3/1970 | Hartmann | 264/210 |
| 3,542,615 | 11/1970 | Dobo et al. | 156/181 |
| 3,692,618 | 9/1972 | Dorschner et al. | 161/72 |
| 3,802,817 | 4/1974 | Matsuki et al. | 425/66 |
| 3,849,241 | 11/1974 | Butin et al. | 161/169 |
| 3,855,046 | 12/1974 | Hansen et al. | 161/150 |
| 4,041,203 | 8/1977 | Brock et al. | 428/157 |
| 4,340,563 | 7/1982 | Appel et al. | 264/518 |
| 4,501,586 | 2/1985 | Holtman | 604/380 |
| 4,663,220 | 5/1987 | Wisneski et al. | 428/221 |
| 5,108,820 | 4/1992 | Kaneko et al. | 428/198 |
| 5,108,827 | 4/1992 | Gessner | 428/219 |
| 5,169,706 | 12/1992 | Collier, IV et al. | 428/152 |
| 5,223,339 | 6/1993 | Kletecka et al. | 428/394 |
| 5,225,500 | 7/1993 | Elder et al. | 526/127 |
| 5,270,410 | 12/1993 | Job | 526/124 |
| 5,272,003 | 12/1993 | Peacock | 428/357 |
| 5,336,552 | 8/1994 | Strack et al. | 428/224 |
| 5,340,917 | 8/1994 | Eckman et al. | 528/481 |
| 5,478,646 | 12/1995 | Asanuma et al. | 428/364 |

FOREIGN PATENT DOCUMENTS

| | | | |
|---|---|---|---|
| 0 414 047 | 2/1991 | European Pat. Off. | D01F 6/06 |
| 0 586 924 | 3/1994 | European Pat. Off. | D04H 1/54 |
| 0 634 505 | 1/1995 | European Pat. Off. | D01F 6/46 |
| WO 94/15003 | 7/1994 | WIPO | D01F 6/06 |

OTHER PUBLICATIONS

*Polymer Blends and Composites* by John A. Manson and Leslie H. Sperling, Plenum Press, New York, Copyright 1976, IBN-0-306-30831-2, pp. 273-277.

*Primary Examiner*—Richard Weisberger
*Attorney, Agent, or Firm*—James B. Robinson

[57] ABSTRACT

There is provided a method of producing a nonwoven fabric with a wide bonding window by forming a nonwoven web from a thermoplastic polymer blend including from about 0.5 weight percent to about 25 weight percent of syndiotactic polypropylene and then thermally bonding the nonwoven web by a method such as thermal point bonding, through-air-bonding and ultrasonic bonding. Such a web has a bonding window at least 10° F. wider than that of a similar web without syndiotactic polypropylene. Ideally, the bonding window will extend at least 10° F. below that of a similar web without syndiotactic polypropylene.

2 Claims, 2 Drawing Sheets

Cross Machine

Peak Load vs Bonding Temperature

× 0% sPP
+ 2% spp
□ 5% sPP
◇ 10% sPP

Trap Tear vs Bonding Temperature

× 0% sPP
+ 2% sPP
□ 5% sPP
◇ 10% sPP

METHOD OF PROVIDING A NONWOVEN FABRIC WITH A WIDE BONDING WINDOW

BACKGROUND OF THE INVENTION

Nonwoven webs are used in a growing number of applications because of the many different properties which can be obtained from them through the use of different polymers, thicknesses, bonding processes and a myriad of other variables available to the producer to meet the specific need of the customer. These diverse applications broadly include filtration, such as in automobile cabin air filters, personal care products such as wipers, diapers, feminine hygiene products, training pants, incontinence products and the like, medical applications such as wound dressings, surgical gowns, bandages and surgical drapes, protective covers like equipment (e.g. car) covers, garments, outdoor fabrics and geotextiles.

The polymers used to produce nonwoven webs are usually thermoplastic polymers like polyolefins, polyamides, polyesters and the like. Elastomeric thermoplastics are also used and these include polyetheresters and polyurethanes.

Specific nonwoven materials for these applications include meltblown and spunbond fabrics having varying degrees of barrier, softness and breathability.

Meltblown fibers are generally tacky when produced and as a result naturally bond together and so do not normally need to be further bonded, though they could be. Spunbond fibers, by contrast, are normally cooled sufficiently before contacting other fibers so that such fibers do not naturally bond and therefore need to be further bonded.

Various methods of bonding are known in the art. Examples include thermal point bonding, ultrasonic bonding, hydro-entanglement and through-air-bonding.

Thermal point bonding is quite common and involves passing a fabric or web of fibers to be bonded between a heated calender roll and an anvil roll. The calender roll is usually patterned in some way so that the entire fabric is not bonded across its entire surface. As a result, various patterns for calender rolls have been developed for functional as well as aesthetic reasons. One example is the expanded Hansen Pennings pattern with about a 15% bond area with about 100 bonds/square inch as taught in U.S. Pat. No. 3,855,046 to Hansen and Pennings. Another common pattern is a diamond pattern with repeating and slightly offset diamonds.

Most types of bonding are relatively energy intensive operations needing fairly precise control over process conditions in order to maintain a target temperature. The reason such precise temperature control is needed is that most polymers have a fairly narrow "bonding window", i.e., the temperature range over which they will bond effectively. In some cases this bonding window is only a few degrees wide. Polyethylene, for example, has a bonding window of about 3° C. Such a narrow bonding window makes industrial production of such materials a fairly difficult endeavor. A wider bonding window would make process control an easier proposition and, if bonding were to take place at a lower temperature, would result in appreciable energy savings.

Accordingly, it is an objective of this invention to widen the bonding window of polymers used to produce bonded nonwoven webs. It is a secondary objective to lower the bonding temperature of nonwoven webs.

SUMMARY OF THE INVENTION

The objects of the invention are accomplished by a method of providing a nonwoven fabric with a wide bonding window by forming a nonwoven web from a thermoplastic polymer blend with about 0.5 weight percent to about 25 weight percent of syndiotactic polypropylene (sPP) and thermally bonding the web. The thermal bonding may be by a method such as thermal point bonding, through-air-bonding and ultrasonic bonding. Such a web has a bonding window at least 10° F. wider than that of a similar web without syndiotactic polypropylene. Ideally, the bonding window will extend at least 10° F. below that of a similar web without syndiotactic polypropylene.

Figure 1:
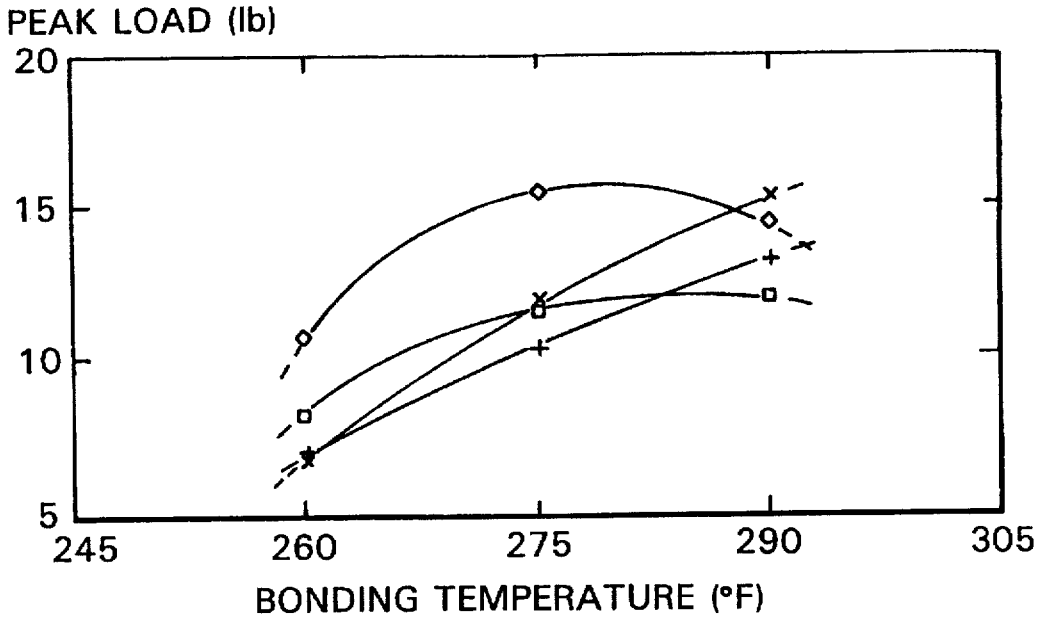
FIG. 1 is a graph of the cross machine direction Peak Load in pounds on the vertical axis, versus Bonding Temperature in degrees Fahrenheit on the horizontal axis. This data is presented in tabular form in Table 1.
Figure 2:
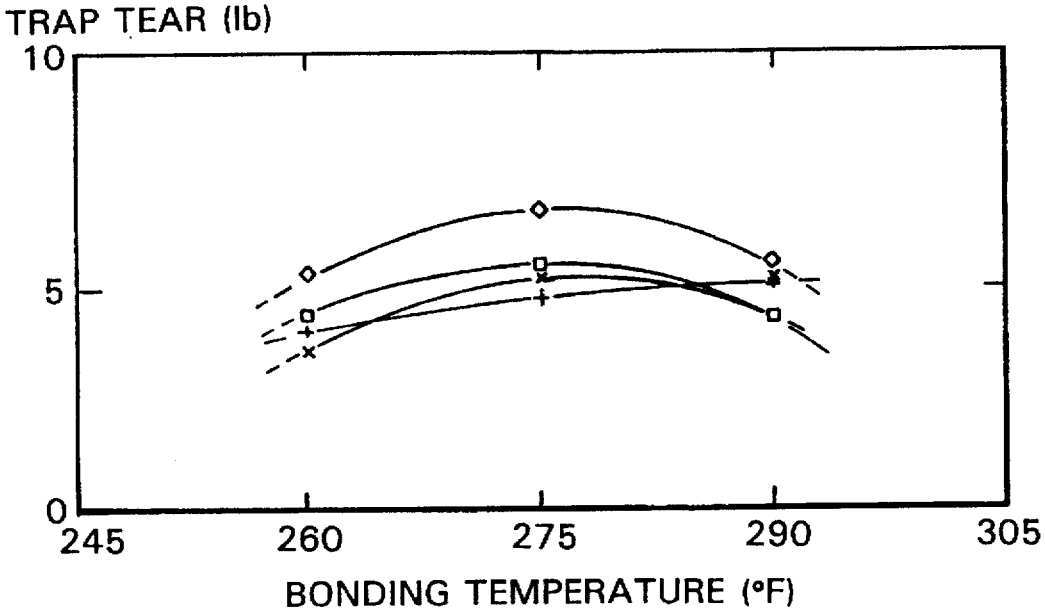
FIG. 2 is a graph of the cross machine direction Trap Tear in pounds on the vertical axis, versus Bonding Temperature in degrees Fahrenheit on the horizontal axis. This data is presented in tabular form in Table 2.
Figure 3:
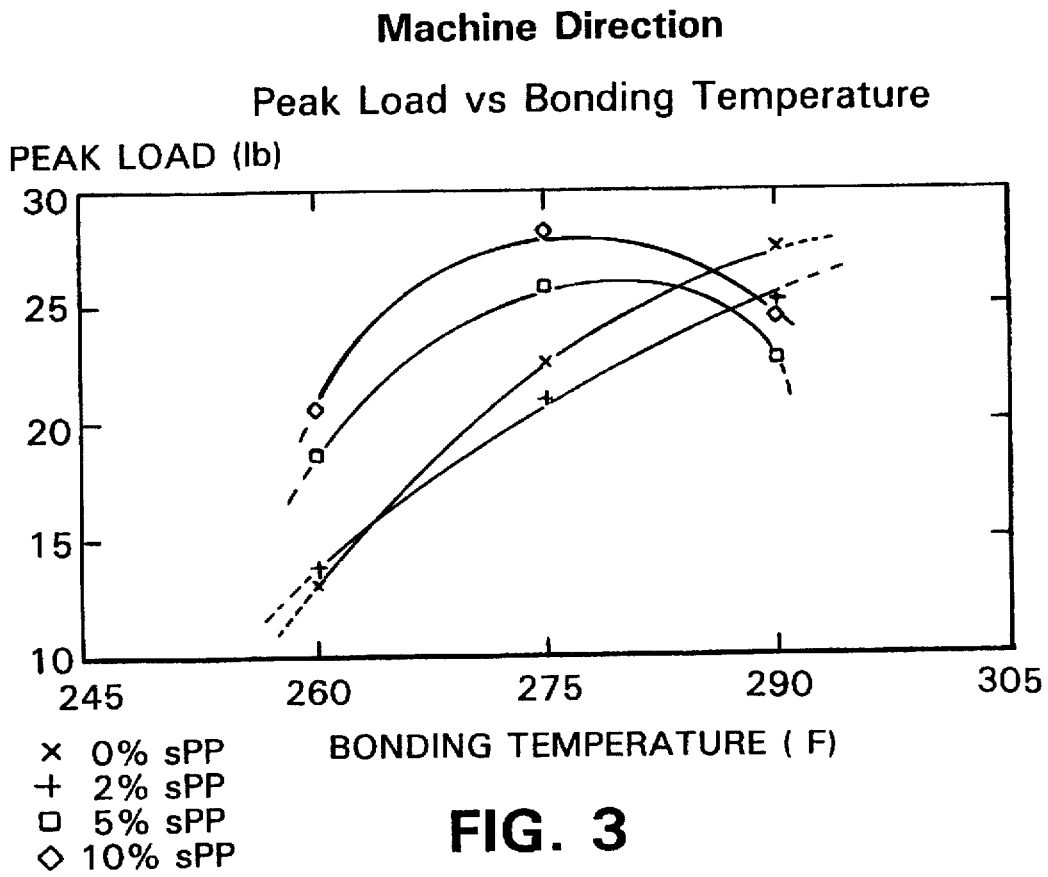
FIG. 3 is a graph of the machine direction Peak Load in pounds on the vertical axis, versus Bonding Temperature in degrees Fahrenheit on the horizontal axis. This data is presented in tabular form in Table 1.
Figure 4:
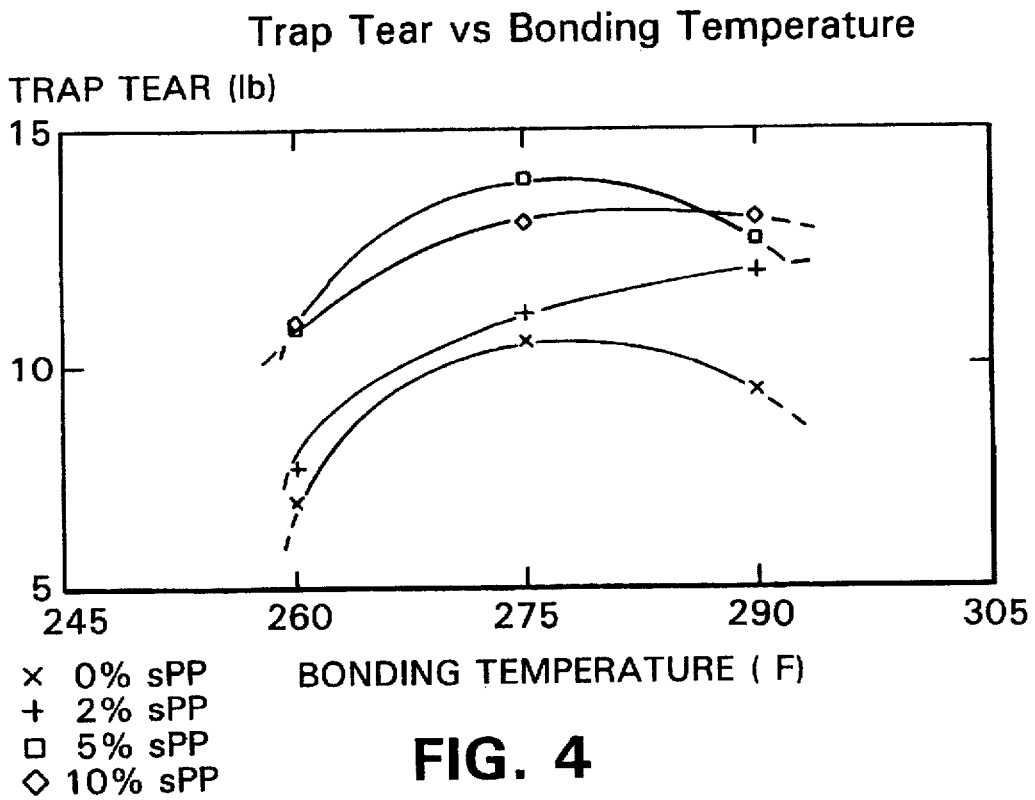
FIG. 4 is a graph of the machine direction Trap Tear in pounds on the vertical axis, versus Bonding Temperature in degrees Fahrenheit on the horizontal axis. This data is presented in tabular form in Table 2.

In all of the Figures, the x symbol represents data at 0 weight percent sPP (the data of Control 1), the plus symbol represents data at 2 weight percent sPP (the data of Example 1), the small square represents the data at 5 weight percent sPP (the data of Example 2) and the small diamond represents the data at 10 weight percent sPP (the data of Example 3).

DEFINITIONS

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier, which is defined as grams per 9000 meters of a fiber. For example, the diameter of a polypropylene fiber given in microns may be converted to denier by squaring, and multiplying the result by 0.00629, thus, a 15 micron polypropylene fiber has a denier of about 1.42 ($15^2 \times 0.00629 = 1.415$).

As used herein the term "spunbonded fibers" refers to small diameter fibers which are formed by extruding molten thermoplastic material as filaments from a plurality of fine, usually circular capillaries of a spinnerette with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Levy, and U.S. Pat. No. 3,542,615 to Dobo et al. Spunbond fibers are generally not tacky when they are deposited onto a collecting surface. Spunbond fibers are generally continuous and have diameters larger than 7 microns, more particularly, between about 10 and 20 microns.

As used herein the term "meltblown fibers" means fibers formed by extruding a molten thermoplastic material through a plurality of fine, usually circular, die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241 to Butin. Meltblown fibers are microfibers which may be continuous or discontinuous, are generally smaller than 10 microns in diameter, and are generally tacky and self adherent when deposited onto a collecting surface.

As used herein the term "polymer" generally includes but is not limited to, homopolymers, copolymers, such as for example, block, graft, random and alternating copolymers, terpolymers, etc. and blends and modifications thereof.

As used herein, the term "machine direction" or MD means the length of a fabric in the direction in which it is produced. The term "cross machine direction" or CD means the width of fabric, i.e. a direction generally perpendicular to the MD.

As used herein the term "homopolymer" fiber refers to the fiber or part of a fiber formed from one extruder using only one polymer. This is not meant to exclude fibers formed from one polymer to which small amounts of additives have been added for coloration, anti-static properties, lubrication, hydrophilicity, etc. These additives, e.g. titanium dioxide for coloration, are generally present in an amount less than 5 weight percent and more typically about 2 weight percent. The term "homopolymer" is also not meant to exclude a fiber formed from two or more extruders wherein both of the extruders contain the same polymer.

As used herein the term "bicomponent fibers" refers to fibers which have been formed from at least two polymers extruded from separate extruders but spun together to form one fiber. Bicomponent fibers are also sometimes referred to as multicomponent fibers. The polymers are usually different from each other though bicomponent fibers may be homopolymer fibers. The polymers are arranged in substantially constantly positioned distinct zones across the cross-section of the bicomponent fibers and extend continuously along the length of the bicomponent fibers. The configuration of such a bicomponent fiber may be, for example, a sheath/core arrangement wherein one polymer is surrounded by another or may be a side by side arrangement or an "islands-in-the-sea" arrangement. Bicomponent fibers are taught in U.S. Pat. No. 5,108,820 to Kaneko et al., U.S. Pat. No. 5,336,552 to Strack et al., and European Patent 0586924. For two component fibers, the polymers may be present in ratios of 75/25, 50/50, 25/75 or any other desired ratios.

As used herein the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, through air bonding or "TAB" means a process of bonding a nonwoven bicomponent fiber web which is wound at least partially around a perforated roller which is enclosed in a hood or oven. Air which is sufficiently hot to melt one of the polymers of which the fibers of the web are made is forced from the hood, through the web and into the perforated roller. The air velocity is between 100 and 500 feet per minute and the dwell time may be as long as 6 seconds. The melting and resolidification of the polymer provides the bonding. Through air bonding has restricted variability and is generally regarded a second step bonding process. Since TAB requires the melting of at least one component to accomplish bonding, it is restricted to non-homopolymer bicomponent fiber webs.

As used herein, the term "bonding window" means the range of temperature used to bond the nonwoven fabric together, over which such bonding is "successful". "Successful" bonding means bonding wherein the nonwoven web meets the tensile and tear strength requirements for a particular desired end use application. For isotactic polypropylene spunbond, this bonding window is typically from about 275° F. to about 310° F. (135° C. to 154° C.). Below about 275° F. the polypropylene is typically not hot enough to melt and bond and above about 310° F. the polypropylene will melt excessively and can stick to the calender rolls. Polyethylene has an even narrower bonding window.

As used herein, the term "barrier fabric" means a fabric which is relatively impermeable to the transmission of liquids, i.e., a fabric which has blood strikethrough rate of 1.0 or less according to ASTM test method 22.

As used herein, the term "garment" means any type of non-medically oriented apparel which may be worn. This includes industrial workwear and coveralls, undergarments, pants, shirts, jackets, gloves, socks, and the like.

As used herein, the term "infection control product" means medically oriented items such as surgical gowns and drapes, face masks, head coverings like bouffant caps, surgical caps and hoods, footwear like shoe coverings, boot covers and slippers, wound dressings, bandages, sterilization wraps, wipers, garments like lab coats, coveralls and gowns, aprons and jackets, patient bedding, stretcher and bassinet sheets, and the like.

As used herein, the term "personal care product" means diapers, training pants, absorbent underpants, adult incontinence products, and feminine hygiene products.

As used herein, the term "protective cover" means a cover for vehicles such as cars, trucks, boats, airplanes, motorcycles, bicycles, golf carts, etc., covers for equipment often left outdoors like grills, yard and garden equipment (mowers, roto-tillers, etc.) and lawn furniture, as well as floor coverings, table cloths and picnic area covers.

As used herein, the term "outdoor fabric" means a fabric which is primarily, though not exclusively, used outdoors. Outdoor fabric includes fabric used in protective covers, camper/trailer fabric, tarpaulins, awnings, canopies, tents, agricultural fabrics and outdoor apparel such as head coverings, industrial work wear and coveralls, pants, shirts, jackets, gloves, socks, shoe coverings, and the like.

TEST METHODS

Melt Flow Rate: The melt flow rate (MFR) is a measure of the viscosity of a polymers. The MFR is expressed as the weight of material which flows from a capillary of known dimensions under a specified load or shear rate for a measured period of time and is measured in grams/10 minutes at 230° C. according to, for example, ASTM test 1238, condition E.

Hydrohead: A measure of the liquid barrier properties of a fabric is the hydrohead test. The hydrohead test determines the height of water (in centimeters) which the fabric will support before a predetermined amount of liquid passes through. A fabric with a higher hydrohead reading indicates it has a greater barrier to liquid penetration than a fabric with a lower hydrohead. The hydrohead test is performed according to Federal Test Standard No. 191A, Method 5514.

Tensile: The tensile strength of a fabric may be measured according to the ASTM test D-1682-64. This test measures the strength in pounds and elongation in percent of a fabric.

Grab Tensile test: The grab tensile test is a measure of breaking strength and elongation or strain of a fabric when subjected to unidirectional stress. This test is known in the art and conforms to the specifications of Method 5100 of the Federal Test Methods Standard No. 191A. The results are expressed in pounds to break and percent stretch before breakage. Higher numbers indicate a stronger, more stretchable fabric. The term "load" means the maximum load or force, expressed in units of weight, required to break or rupture the specimen in a tensile test. The term "strain" or "total energy" means the total energy under a load versus elongation curve as expressed in weight-length units. The term "elongation" means the increase in length of a specimen during a tensile test. Values for grab tensile strength and grab elongation are obtained using a specified width of fabric, clamp width and a constant rate of extension. The sample is wider than the clamp to give results representative of effective strength of fibers in the clamped width combined with additional strength contributed by adjacent fibers in the fabric. This closely simulates fabric stress conditions in actual use.

Trap Tear test: The trapezoid or "trap" tear test is a tension test applicable to both woven and nonwoven fabrics. The entire width of the specimen is gripped between clamps, thus the test primarily measures the bonding or interlocking and strength of individual fibers directly in the tensile load, rather than the strength of the composite structure of the fabric as a whole. The procedure is useful in estimating the relative ease of tearing of a fabric. It is particularly useful in the determination of any appreciable difference in strength between the machine and cross direction of the fabric. In conducting the trap tear test, a trapezoid is cut from a 3 by 6 inch (75 by 150 mm) specimen with the longer dimension in the direction being tested. The trapezoid has a 6 inch side and a 3 inch side which are parallel and which are separated by 3 inches. A small preliminary cut or notch of ⅝ inches (15 mm) is made in the middle of the shorter of the parallel sides. The specimen is clamped in a dynamometer, such as for example, an Instron Model TM available from the Instron Corporation, 2500 Washington St., Canton, Mass. 02021, or a Thwing-Albert Model INTELLECT II available from the Thwing-Albert Instrument Co., 10960 Dutton Rd., Phila., Pa. 19154, or a Sintech 2/S using Testworks software available from Sintech, a division of MTS Systems Corporation, 1001 Sheldon Dr., Cary, N.C. 27513. The clamps are parallel and 1 inch (25 mm) apart and are 3 inches long by 1 inch in height. The specimen is clamped along the non-parallel sides of the trapezoid so that the fabric on the longer side is loose and the fabric along the shorter side taut, and with the cut halfway between the clamps. The clamps cover a 1 by 3 inch area of fabric to leave a trapezoidal fabric with a 1 inch edge and a parallel 4 inch (100 mm) edge between the clamps. The leading point of the cut or notch into the fabric must be between the clamps. A continuous load is applied on the specimen such that the tear propagates across the specimen width. It should be noted that the longer direction is the direction being tested even though the tear is perpendicular to the length of the specimen. The force required to completely tear the specimen is recorded in pounds with higher numbers indicating a greater resistance to tearing. The test method used conforms to ASTM Standard test D1117-14 except that the tearing load is calculated as the average of the first and highest peaks recorded rather than the lowest and highest peaks. Five specimens for each sample should be tested.

DETAILED DESCRIPTION OF THE INVENTION

Nonwoven fabrics may be produced by a number of processes known in the art including meltblowing, spunbonding and meltspraying. Since this invention concerns bonding of nonwoven webs, most of the focus is on spunbond webs. The description and process which follow apply, however, to any nonwoven web which is bonded.

Spunbond nonwoven fabric is produced by a method known in the art and described in a number of the references cited above. Briefly, the spunbond process generally uses a hopper which supplies polymer to a heated extruder. The extruder supplies melted polymer to a spinnerette where the polymer is fiberized as it passes through fine openings usually arranged in one or more rows in the spinnerette, forming a curtain of filaments. The filaments are usually quenched with air at a low pressure, drawn, usually pneumatically, and deposited on a moving foraminous mat, belt or "forming wire" to form the nonwoven fabric.

The fibers produced in the spunbond process are usually in the range of from about 10 to about 20 microns in diameter, depending on process conditions and the desired end use for the fabrics to be produced from such fibers. For example, increasing the polymer molecular weight or decreasing the processing temperature result in larger diameter fibers. Changes in the quench fluid temperature and pneumatic draw pressure can also affect fiber diameter.

Polymers useful in the spunbond process generally have a process melt temperature of between about 350° F. to about 610° F. (175° C. to 320° C.) and a melt flow rate, as defined above, in the range of about 10 to about 150, more particularly between about 10 and 50. Examples of suitable polymers include polypropylenes, polyethylene and polyamides.

Syndiotactic polypropylene (sPP) may be produced according to the method taught in U.S. Pat. No. 5,225,500 to Elder et al. and assigned to Fina Petroleum, and hereby incorporated by reference. A novel catalyst system having high selectivity for syndiotactic polypropylene is used to preferentially produce polypropylene having predominately syndiotactic configuration. This catalyst is known as a metallocene catalyst.

U.S. Pat. No. 5,272,003 to Peacock and assigned to Exxon Chemical Patents, Inc., and hereby incorporated by reference, teaches the production of a nonwoven web from neat syndiotactic polypropylene from a solution designed to exclude isotactic polypropylene.

The widening of the bonding window which is the subject of this invention is accomplished by thermally bonding a nonwoven web wherein the fibers are comprised of a blend of thermoplastic polymers including from about 0.5 to about 25 weight percent of syndiotactic polypropylene, resulting in a biconstituent fiber. The syndiotactic polypropylene can be blended with the other components of the blend as a dry mixture of pellets, flakes, etc., as a melted liquid blend, or by any other effective method known in the art.

Other types of biconstituent fibers may also be produced using the practice of this invention. Blends of a copolymer of propylene and butylene or other olefins in a mixture with syndiotactic polypropylene would be effective. Blends of isotactic polypropylene and syndiotactic polypropylene are preferred.

Bicomponent fibers may also be produced using the practice of this invention wherein at least one of the components consists of a biconstituent blend including syndiotactic polypropylene. Bicomponent fibers are commonly polypropylene and polyethylene arranged in a sheath/core, "islands in the sea" or side by side configuration. Suitable commercially available materials include polypropylene designated PP-3445 from the Exxon Chemical Company of Baytown, Tex., ASPUN® 6811A to which the syndiotactic polypropylene can be added, and 2553 linear low density polyethylene from the Dow Chemical Company of Midland, Mich., 25355 and 12350 high density polyethylene from the Dow Chemical Company, DURAFLEX® DP 8510 polybutylene available from the Shell Chemical Company of Houston, Tex., and ENATHENE® 720-009 ethylene n-butyl acrylate from the Quantum Chemical Corporation of Cincinnati, Ohio.

The fabric of this invention may be used in a single layer embodiment or as a component of a multilayer laminate which may be formed by a number of different laminating techniques including but not limited to using adhesive, needle punching, thermal calendering and any other method known in the art. Such a multilayer laminate may be an embodiment wherein some of the layers are spunbond and some meltblown such as a spunbond/meltblown/spunbond (SMS) laminate as disclosed in U.S. Pat. No. 4,041,203 to Brock et al. and U.S. Pat. No. 5,169,706 to Collier, et al or a SFS (spunbond, film, spunbond) construction. An SMS laminate may be made by sequentially depositing onto a moving forming belt first a spunbond fabric layer, then a meltblown fabric layer and last another spunbond layer and then bonding the laminate in a manner described above. Alternatively, the three fabric layers may be made individually, collected in rolls, and combined in a separate bonding step. Some of such SMS or SFS layers may be made from the fabric of this invention. The fabric of this invention may also be laminated with, glass fibers, staple fibers, paper, and other web materials.

The nonwoven meltblown fibers or the film used in an intermediate layer may be made from non-elastomeric polymers such as polypropylene and polyethylene or may be made from an elastomeric thermoplastic polymer.

Elastomeric thermoplastic polymer may be those made from styrenic block copolymers, polyurethanes, polyamides, copolyesters, ethylene vinyl acetates (EVA) and the like. Generally, any suitable elastomeric fiber or film forming resins or blends containing the same may be utilized to form the nonwoven webs of elastomeric fibers or elastomeric film.

Commercial examples of such elastomeric copolymers are, for example, those known as KRATON® materials which are available from Shell Chemical Company of Houston, Tex. KRATON® block copolymers are available in several different formulations, a number of which are identified in U.S. Pat. No. 4,663,220, hereby incorporated by reference.

Other exemplary elastomeric materials which may be used to form an elastomeric layer include polyurethane elastomeric materials such as, for example, those available under the trademark ESTANE® from B. F. Goodrich & Co., polyamide elastomeric materials such as, for example, those available under the trademark PEBAX® from the Rilsan Company, and polyester elastomeric materials such as, for example, those available under the trade designation HYTREL® from E. I. DuPont De Nemours & Company.

Various mixtures of syndiotactic polypropylene with isotactic polypropylene were produced in order to measure the bonding window of the resultant web. Control fabrics were also produced having no syndiotactic polymer. Two sets of tests were run producing fabrics with stabilizer and pigment and fabrics with stabilizer and without pigment, in order to determine whether the syndiotactic polypropylene was responsible for the change in the bonding window or whether another mechanism was responsible. The results of these tests are shown in the tables that follow.

CONTROL 1

Spunbond polypropylene fibers having stabilizer and pigment were produced according to the method of U.S. Pat. No. 4,340,563 to Appel et al.

The polymer of the spunbond fiber was Exxon PD-3445 polypropylene extruded through 0.6 mm holes at a rate of 0.7 grams/hole/minute (ghm) at a temperature of 410° F. (210° C.) to produce a web of fibers having a basis weight of 1 osy (34 gsm). The polymer also had 1.25 weight percent of Chimasorb 944 ultraviolet stabilizer available commercially from Ciba-Geigy Corporation, and 1.0 weight percent of SCC-5367 pigment package, available commercially from the Standridge Color Corporation of Social Circle, Ga.

Three samples of the web of fibers were produced and bonded at temperatures of 260°, 275°and 290° F. (127°, 135°and 143° C.) using thermal point calender bonding with an expanded Hansen Penning pattern.

EXAMPLE 1

Spunbond polypropylene fibers having stabilizer and pigment were produced and bonded at the same conditions as in Control 1.

The polymer of the spunbond fiber was a mixture of 2 weight percent syndiotactic polypropylene from the Fina Oil and Chemical Company of Dallas, Tex. and Exxon PD-3445 polypropylene. The polymer also had Chimasorb 944 ultraviolet stabilizer and pigment in the same amounts as in Control 1.

EXAMPLE 2

Spunbond polypropylene fibers having stabilizer and pigment were produced and bonded at the same conditions as in Control 1.

The polymer of the spunbond fiber was a mixture of 5 weight percent syndiotactic polypropylene from the Fina Oil and Chemical Company of Dallas, Tex. and Exxon PD-3445 polypropylene. The polymer also had Chimasorb 944 ultraviolet stabilizer and pigment in the same amounts as in Control 1.

EXAMPLE 3

Spunbond polypropylene fibers having stabilizer and pigment were produced and bonded at the same conditions as in Control 1.

The polymer of the spunbond fiber was a mixture of 10 weight percent syndiotactic polypropylene from the Fina Oil and Chemical Company of Dallas, Tex. and Exxon PD-3445 polypropylene. The polymer also had Chimasorb 944 ultraviolet stabilizer and pigment in the same amounts as in Control 1.

CONTROL 2

Spunbond polypropylene fibers having stabilizer but no pigment were produced and bonded at the same conditions as in Control 1.

The polymer of the spunbond fiber was Exxon PD-3445 polypropylene. The polymer also had 1.25 weight percent of Chimasorb 944 ultraviolet stabilizer but no pigment.

EXAMPLE 4

Spunbond polypropylene fibers having stabilizer but no pigment were produced and bonded at the same conditions as in Control 1.

The polymer of the spunbond fiber was a mixture of 5 weight percent syndiotactic polypropylene from the Fina Oil and Chemical Company of Dallas, Tex. and Exxon PD-3445 polypropylene. The polymer also had 1.25 weight percent of Chimasorb 944 ultraviolet stabilizer but no pigment.

TABLE 1

| Sample | CD Peak Load | MD Peak Load | CD Peak Energy | MD Peak Energy |
|---|---|---|---|---|
| Control 1 | | | | |
| 260° F. | 7 | 13 | 11 | 16 |
| 275° F. | 12 | 23 | 12 | 20 |
| 290° F. | 15 | 27 | 18 | 25 |
| Example 1, 2 Wt % sPP | | | | |
| 260° F. | 7 | 14 | 11 | 12 |
| 275° F. | 10 | 21 | 17 | 19 |
| 290° F. | 13 | 25 | 17 | 23 |

TABLE 1-continued

| Sample | CD Peak Load | MD Peak Load | CD Peak Energy | MD Peak Energy |
|---|---|---|---|---|
| Example 2, 5 Wt % sPP | | | | |
| 260° F. | 8 | 19 | 14 | 17 |
| 275° F. | 12 | 26 | 20 | 28 |
| 290° F. | 12 | 23 | 16 | 20 |
| Example 3, 10 Wt % sPP | | | | |
| 260° F. | 11 | 21 | 23 | 21 |
| 275° F. | 15 | 28 | 27 | 36 |
| 290° F. | 14 | 24 | 20 | 24 |

TABLE 2

| Sample | CD Peak Strain | MD Peak Strain | CD Trap Tear | MD Trap Tear |
|---|---|---|---|---|
| Control 1 | | | | |
| 260° F. | 78 | 52 | 4 | 7 |
| 275° F. | 82 | 49 | 5 | 11 |
| 290° F. | 72 | 51 | 4 | 9 |
| Example 1, 2 Wt % sPP | | | | |
| 260° F. | 78 | 37 | 4 | 8 |
| 275° F. | 87 | 48 | 5 | 11 |
| 290° F. | 78 | 48 | 5 | 12 |
| Example 2, 5 Wt % sPP | | | | |
| 260° F. | 88 | 42 | 4 | 11 |
| 275° F. | 97 | 57 | 6 | 14 |
| 290° F. | 79 | 45 | 4 | 13 |
| Example 3, 10 Wt % sPP | | | | |
| 260° F. | 113 | 50 | 5 | 11 |
| 275° F. | 104 | 67 | 7 | 13 |
| 290° F. | 84 | 50 | 6 | 13 |

TABLE 3

| Sample | Peak Load | Trap Tear |
|---|---|---|
| Control 2 | | |
| 260° F. | 12 | 7 |
| 275° F. | 20 | 10 |
| 290° F. | 25 | 10 |
| Example 4, 5 Wt % sPP | | |
| 260° F. | 16 | 9 |
| 275° F. | 25 | 12 |
| 290° F. | 26 | 13 |

As can be seen from the above table, syndiotactic polypropylene successfully widens the window of temperature over which bonding can occur, lowering the acceptable bonding temperature by about 15° F. (8° C.). For example, a comparison of Example 3 at 260° F. shows that the web properties are about the same as Control 1 at a much higher 290° F. At 10 or even 5 weight percent syndiotactic polypropylene in the blend, successful bonding may take place at much lower temperatures than a similar web without sPP.

Such improvements in bonding allow for easier process control, less waste and lower energy costs, resulting in more affordable products for the consumer.

What is claimed is:

1. A thermoplastic polymer fiber having a wide bonding window comprising:

a thermoplastic polymer biconstituent blend including from about 0.5 weight percent to about 25 weight percent of syndiotactic polypropylene;

wherein said fiber may be bonded in a temperature range which is at least 10° F. below than that of a similar fiber without said syndiotactic polypropylene.

2. The thermoplastic fiber of claim 1 wherein said blend consists essentially of about 0.5 to about 25 weight percent syndiotactic propylene and about 99.5 to about 75 weight percent isotactic polypropylene.

* * * * *

UNITED STATES PATENT AND TRADEMARK OFFICE

CERTIFICATION OF CORRECTION

PATENT NO. : 5,714,256

DATED : February 3, 1998

INVENTOR(S): DeLucia et al.

It is certified that errors appear in the above-identified patent and that said Letters Patent is hereby corrected as shown below:

Column 5, line 20, "viscosity of a polymers." should read --viscosity of a polymer.--;
Column 8, line 2, "laminated with, glass" should read --laminated with glass--.

Signed and Sealed this

Eighteenth Day of August, 1998

Bruce Lehman

*Attest:*

BRUCE LEHMAN

*Attesting Officer*

*Commissioner of Patents and Trademarks*